US007682200B2

(12) United States Patent
Zheng et al.

(10) Patent No.: US 7,682,200 B2
(45) **Date of Patent: *Mar. 23, 2010**

(54) ELECTRICAL CONNECTOR WITH IMPROVED CONTACTS AND TRANSITION MODULE

(75) Inventors: Qi-Sheng Zheng, Kunshan (CN); Jia-Yong He, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/228,354

(22) Filed: Aug. 11, 2008

(65) Prior Publication Data

US 2009/0042420 A1 Feb. 12, 2009

(30) Foreign Application Priority Data

Aug. 10, 2007 (CN) ..... 2007 2 0042749

(51) Int. Cl.
*H01R 24/00* (2006.01)

(52) U.S. Cl. ..... 439/660; 439/79

(58) Field of Classification Search .....
439/607.07–607.09, 607.11, 607.13, 607.35, 439/607.46, 939, 76.1, 79, 660, 676
See application file for complete search history.

(56) References Cited

U.S. PATENT DOCUMENTS 5,194,010 A 3/1993 Dambach et al.
7,021,971 B2 4/2006 Chou et al.
7,104,848 B1 9/2006 Chou et al.
7,108,520 B1 * 9/2006 Delaney et al. ..... 439/79
7,108,560 B1 9/2006 Chou et al.
7,125,287 B1 10/2006 Chou et al.
7,128,582 B2 10/2006 Fang et al.
7,134,884 B2 11/2006 Wang et al.
7,232,346 B2 * 6/2007 Hu et al. ..... 439/660
7,318,752 B2 * 1/2008 Fujimoto et al. ..... 439/660
7,371,116 B2 * 5/2008 Chiang ..... 439/607.34
2006/0025015 A1 2/2006 Hu et al.
2006/0261474 A1 11/2006 Jiang et al.
2006/0286865 A1 12/2006 Chou et al.
2006/0294272 A1 12/2006 Chou et al.
2009/0042421 A1 * 2/2009 Zheng et al. ..... 439/83

FOREIGN PATENT DOCUMENTS

TW M306723 2/2007

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

An electrical connector mounted on a mother PCB includes an insulative tongue portion and a number of contacts held in the insulative tongue portion. The contacts have four conductive contacts and at least one pair of differential contacts for transferring high speed signals. The conductive contacts are adapted for USB 2.0 protocol. The electrical connector further includes a transition module with one end connected to the contacts and the other end to be soldered to the mother PCB.

14 Claims, 12 Drawing Sheets

ELECTRICAL CONNECTOR WITH IMPROVED CONTACTS AND TRANSITION MODULE

BACKGROUND OF THE INVENTION

1. Field of the Invention

The present invention relates to electrical connectors, more particularly to electrical connectors with additional differential contact pair for transmitting high speed signals and with improved transition module.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

FIGS. 11 and 12 show existing USB connectors. In FIG. 11, this USB connector 500 is an existing USB plug, male connector. In application, the USB plug 500 may be mounted on a board in the peripherals, or may be connected to wires of a cable 57 as shown in FIG. 11. Generally, an insulative outer housing 55 always be molded over a rear end of the USB plug 500 and the cable 57 to secure the USB plug 500, the cable 57 and the insulative outer housing 55 together. The USB plug 500 can also be mounted in an opening in a plastic case of a peripheral, like a portable memory device. The USB plug 500 represents a type-A 2.0 USB connector. The USB plug 500 includes an insulative plug tongue portion 52 formed of an insulating material, four conductive contacts 53 held on the insulative plug tongue portion 52 and an metal shell 54 enclosing the conductive contacts 53 and the insulative plug tongue portion 52. The metal shell 54 touches the insulative plug tongue portion 52 on three of the sides of the plug tongue portion 52 except a top side thereof. The conductive contacts 53 are supported on the top side of the plug tongue portion 52. A receiving cavity 56 is formed between the top side of the plug tongue portion 52 and a top face 541 of the metal shell 54 for receiving a corresponding insulative receptacle tongue portion 62 shown in FIG. 12. The conductive contacts 53 carry the USB signals generated or received by a controller chip in the peripherals.

USB signals typically include power, ground (GND), and serial differential data D+, D−. To facilitate discussion, the four conductive contacts 53 of the USB plug 500 are designated with numeral 531, 532, 533 and 534 in turn as shown in FIG. 11. In application, the four conductive contacts 531, 532, 533 and 534 are used to transfer power, D−, D+ and ground signals, respectively. The two central conductive contacts 532, 533 are used to transfer/receive data to/from the peripheral device or a host device. The four conductive contacts 531, 532, 533 and 534 can be formed of metal sheet in a manner being stamped out therefrom to four separated ones or formed as conductive pads on a printed circuit board (PCB, not shown) supported on the top side of the plug tongue portion 52.

FIG. 12 shows an existing USB receptacle 600, a female USB connector for mating with the existing USB plug 500. The USB receptacle 600 commonly is an integral part of a host or PC. The USB receptacle 600 also presents a type-A USB 2.0 connector. The USB receptacle 600 includes the insulative receptacle tongue portion 62 formed of an insulating material, four conductive contacts 63 held on the insulative receptacle tongue portion 62 and a metal shell 64 shielding the conductive contacts 63 and the insulative receptacle tongue portion 62. The conductive contacts 63 are supported on a bottom surface of the insulative receptacle tongue portion 62. Same to assignment of the four conductive contacts 53 of the USB plug 500, assignment of the four conductive contacts 63 of the USB receptacle 600 is contact 631 for power signal, contact 632 for D− signal, contact 633 for D+ signal and contact 634 for GND. Another receiving cavity 66 is formed between the bottom surface of the insulative receptacle tongue portion 62 and a bottom of the metal shell 64. In application, the USB plug 500 usually disposed in the peripheral device is inserted into the USB receptacle 600 mounted in the host or PC device. The plug tongue portion 52 is received in the receiving cavity 66 of the USB receptacle 600 and the receptacle tongue portion 62 is received in the receiving cavity 56 of the USB plug 500. After full insertion of the USB plug 500, the conductive contacts 531, 532, 533 and 534 of the USB plug 500 make a physical and electrical connection with the conductive contacts 631, 632, 633 and 634 of the USB receptacle 600, respectively, to transmit/receive signal to/from the host device to the peripheral device.

As discussed above, the existing USB connectors have a small size but low transmission rate, while other non-USB connectors (PCI Express, SATA, et al) have a high transmission rate but large size. Neither of them is desirable to implement modern high-speed, miniaturized electronic devices and peripherals.

In order to reasonably arrange contacts of an electrical connector, U.S. Pat. Nos. 5,194,010 and 7,128,582 provide a solution that the electrical connector includes an inner PCB module with one end connecting to the contacts and the other end to be mounted to a mother PCB. Thus, to provide a kind of connector with a high transmission rate for portability and high data transmitting efficiency, and with transition module is much desirable.

BRIEF SUMMARY OF THE INVENTION

An electrical connector mounted on a mother PCB includes an insulative housing, a plurality of contacts retained in the insulative housing and a transition module for connecting the contacts to the mother PCB. The insulative housing includes a base portion and a tongue portion protruding beyond the base portion. The tongue portion extends along a front-to-rear direction and includes a mating end opposite to the base portion. The contacts include a plurality of conductive contacts and at least one pair of differential contacts for transferring high-speed signals. Each conductive contact includes an elastic first contact portion and a first tail portion opposite to the first contact portion. Each differential contact includes a stiff second contact portion and a second tail portion. All the first and the second contact portions are located at a same side of the tongue portion. The first and the second contact portions are arranged in two parallel rows along the front-to-rear direction in condition that the second contact portions are positioned nearer to the mating end than that of the first contact portions. The transition module is mechanically and electrically connected with the first and the second tail portions. The transition module is adapted for being electrically connected to the mother PCB. With such arrangement, the pair of differential contacts can be used for transferring high-speed signals. The transition module can facilitate manufacture and assembly of contacts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
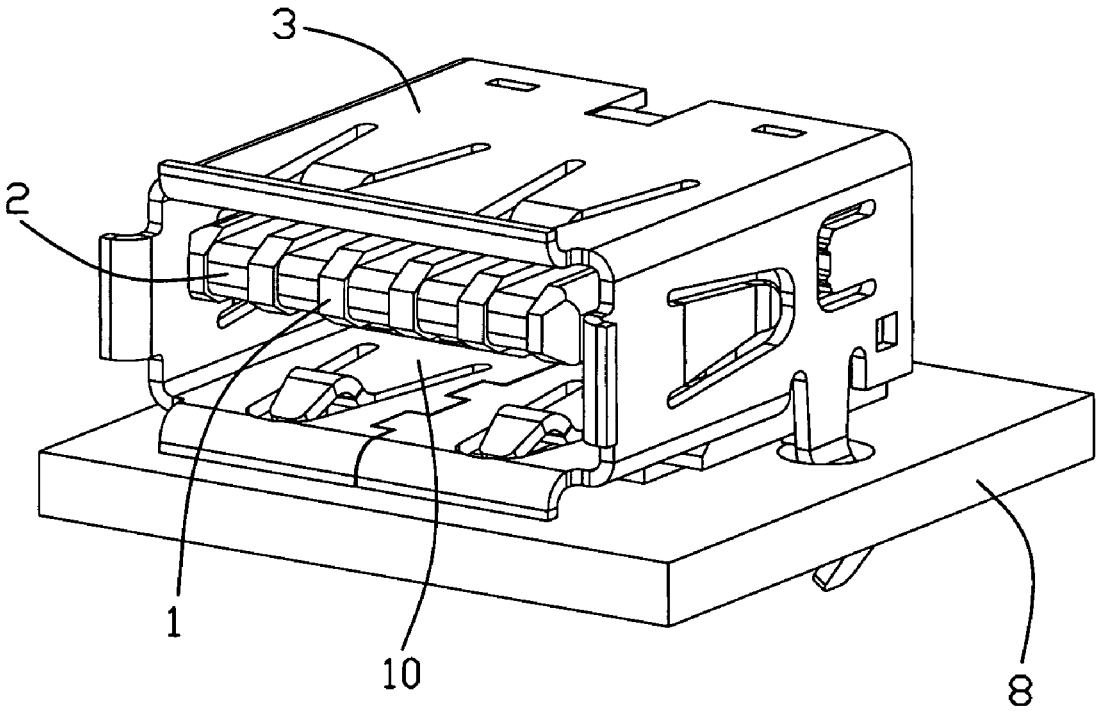
FIG. 1 is a perspective view of an electrical connector mounted on a mother PCB according to a first embodiment of the present invention.
Figure 2:
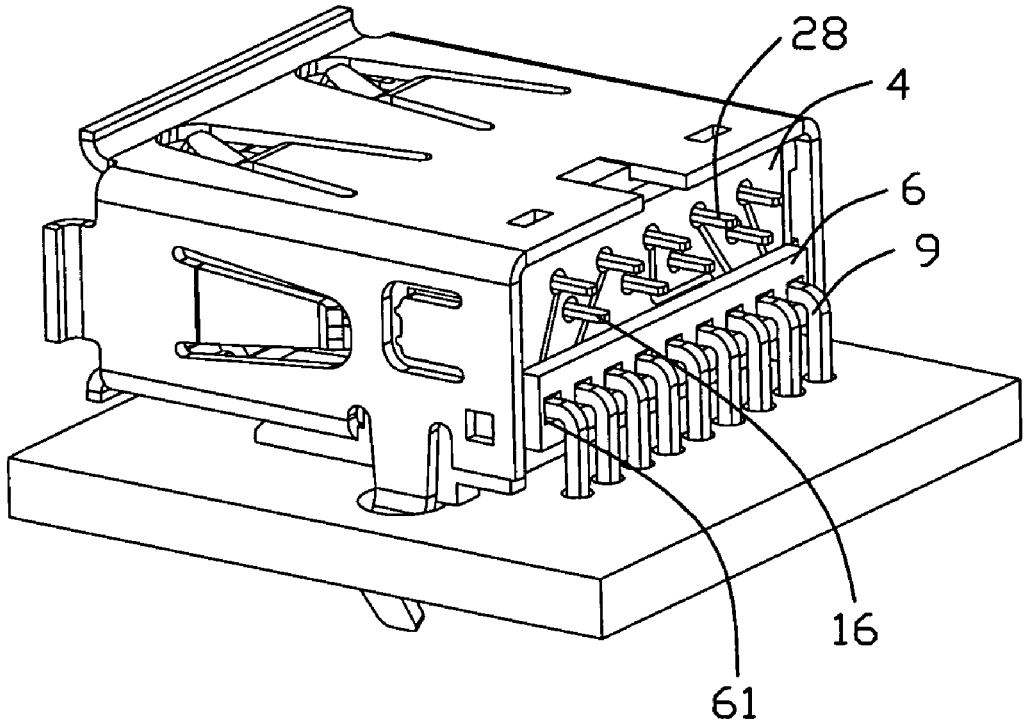
FIG. 2 is another perspective view of the electrical connector mounted on the mother PCB, but viewed from another aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, receptacle, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Referring to FIGS. 1-5, an electrical connector 100 mounted on a mother PCB 8 is disclosed. The electrical connector 100 includes an insulative housing 1, a plurality of contacts 2 held in the insulative housing 1, a metal shell 3 enclosing the insulative housing 1, and a transition module acting as a bridge for connecting the contacts 2 to the mother PCB 8.

Figure 3:
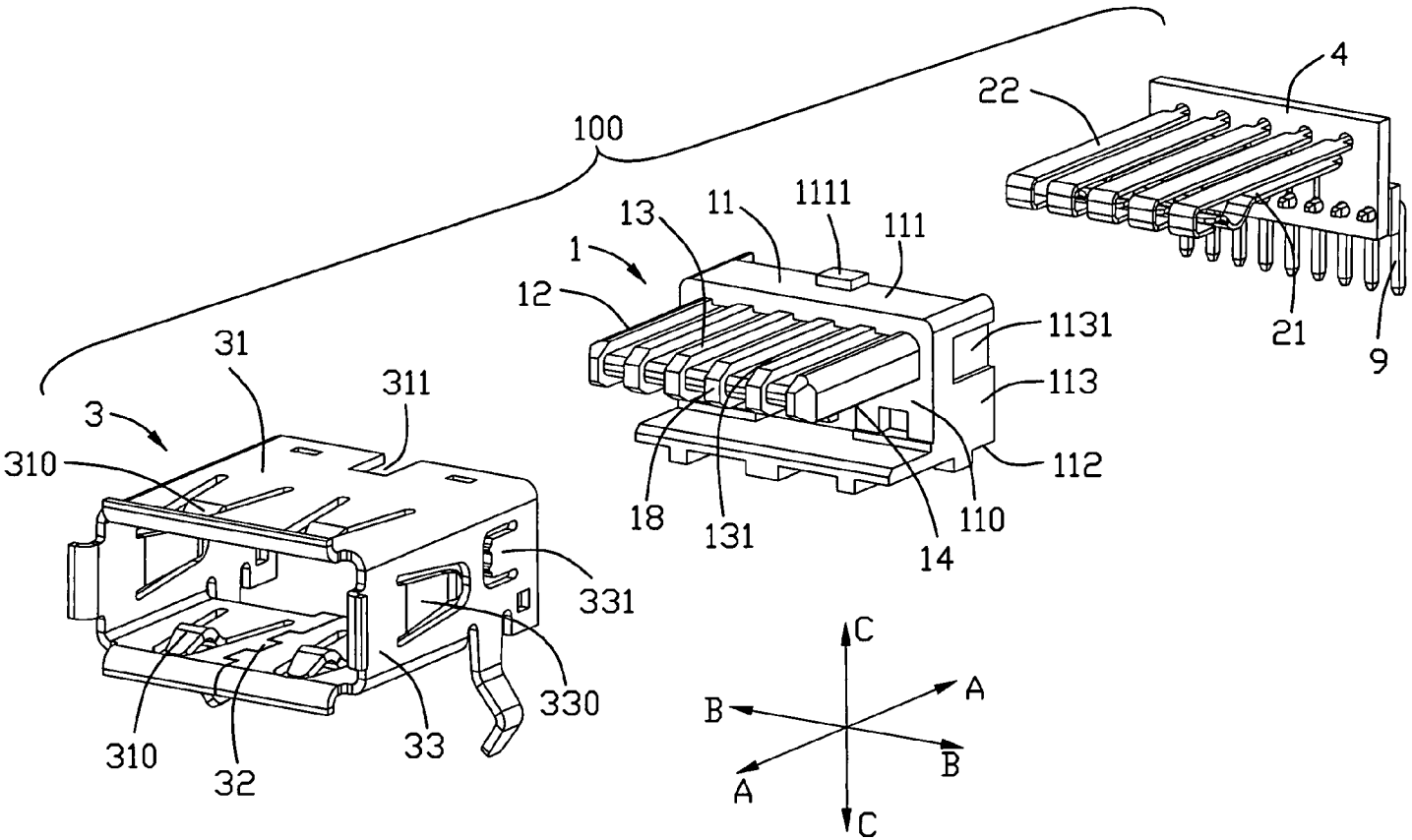
FIG. 3 is a partly exploded view of the electrical connector according to the first embodiment of the present invention.

The insulative housing 1 includes a base portion 11 and a tongue portion 12 extending forwardly from a front surface 110 of the base portion 11. The base portion 11 includes a top section 111, a bottom section 112 opposite to the top section 111, and a pair of side walls 113. The top section 111 includes a protrusion 1111 on its middle portion thereof. Each side wall 113 defines a cutout 1131. The protrusion 1111 and the cutout 1131 are used for abutting against the metal shell 3 which will be detailed hereinafter. The tongue portion 12 extends along a front-to-back direction A-A as shown in FIG. 3 and includes a top wall 13, a mounting wall 14 opposite to the top wall 13, and a mating end 18 opposite to the base portion 11. The top wall 13 defines a plurality of first passageways 131 extending along the front-to-back direction A-A as best shown in FIG. 3. The first passageways 131 further extend backwardly through the base portion 11. The mounting wall 14 defines a plurality of depressions 141 and a plurality of second passageways 142 located at the rear of the depressions 141. The depressions 141 and the second passageways 142 are arranged in two rows along the front-to-back direction A-A. Each row extends along a transverse direction B-B perpendicular to the front-to-back direction A-A. The depressions 141 are located nearer to the mating end 18 than that of the second passageways 142. However, the depressions 141 are separated to the second passageways 142.

Figure 4:
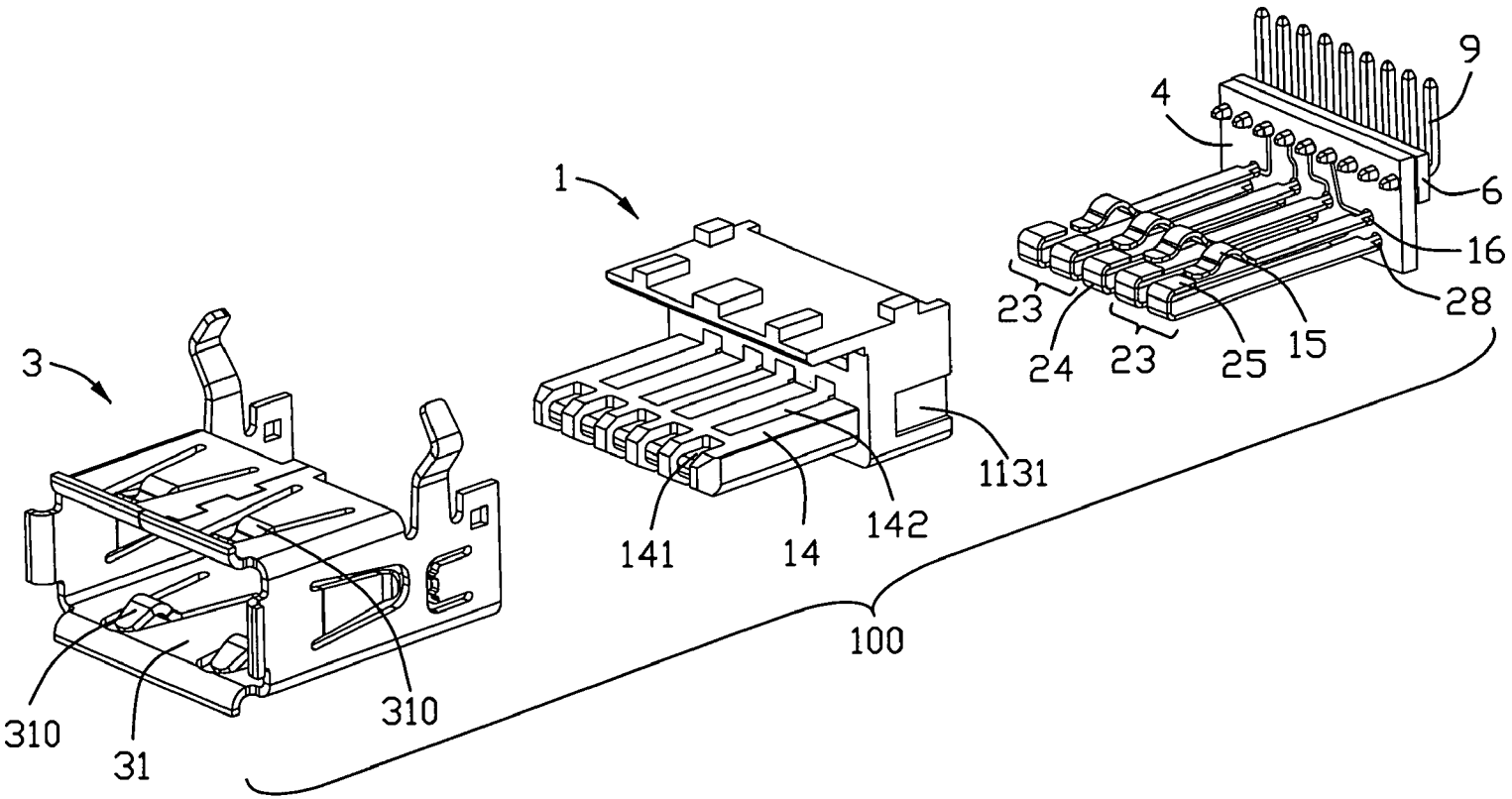
FIG. 4 is another partly exploded view of the electrical connector shown in FIG. 3, but taken from another aspect.
Figure 5:
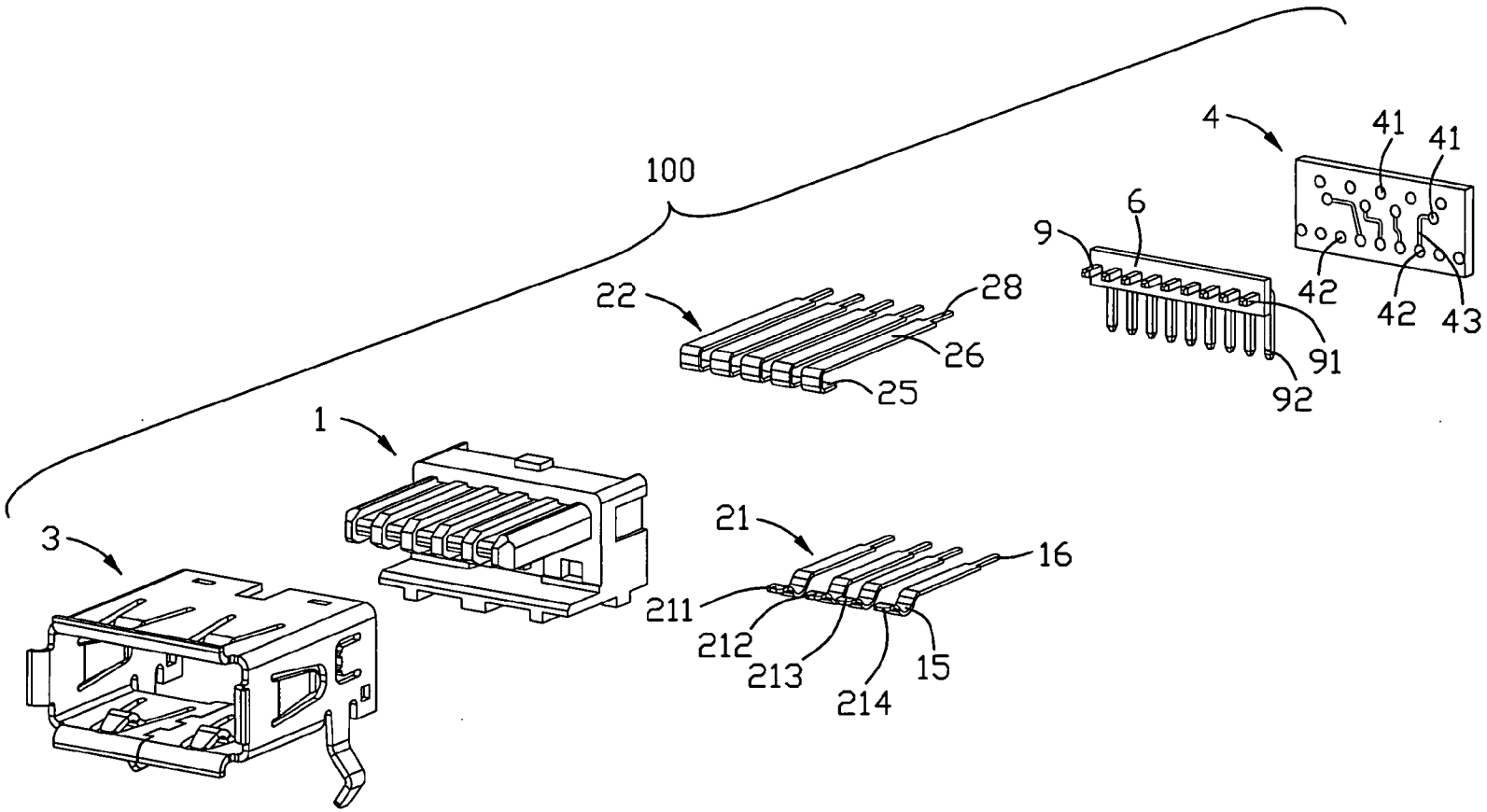
FIG. 5 is an exploded view of the electrical connector according to the first embodiment of the present invention.
Figure 6:
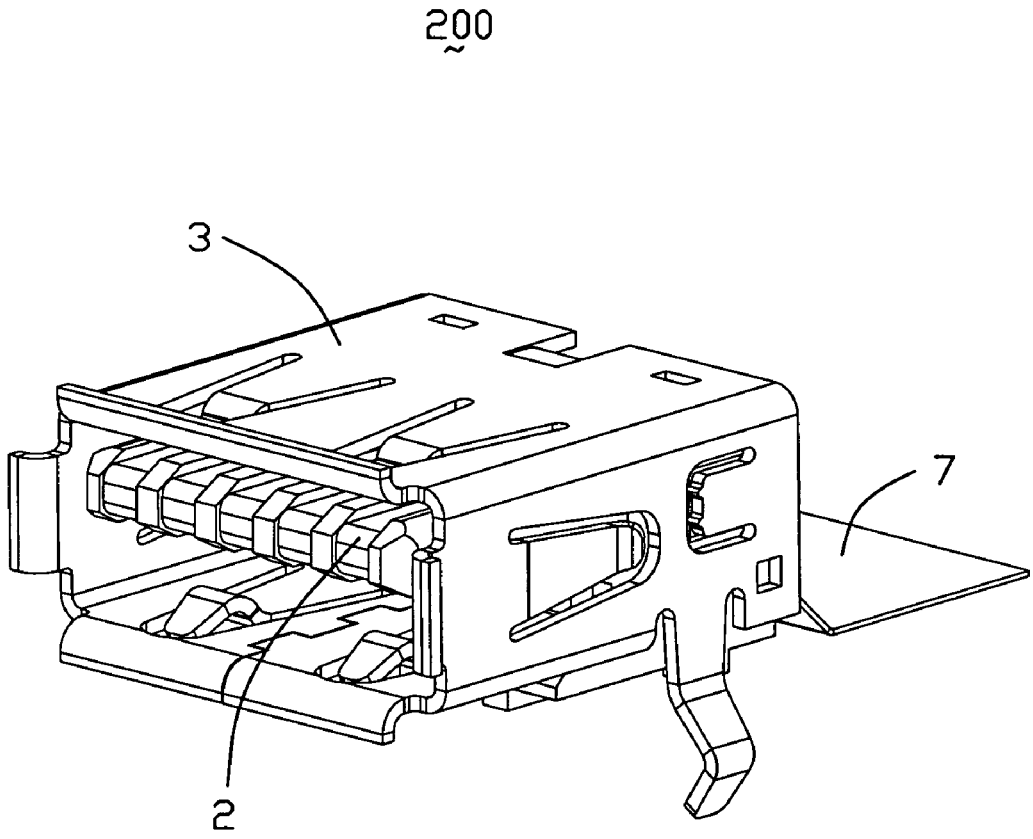
FIG. 6 is a perspective view of an electrical connector according to a second embodiment of the present invention.
Figure 7:
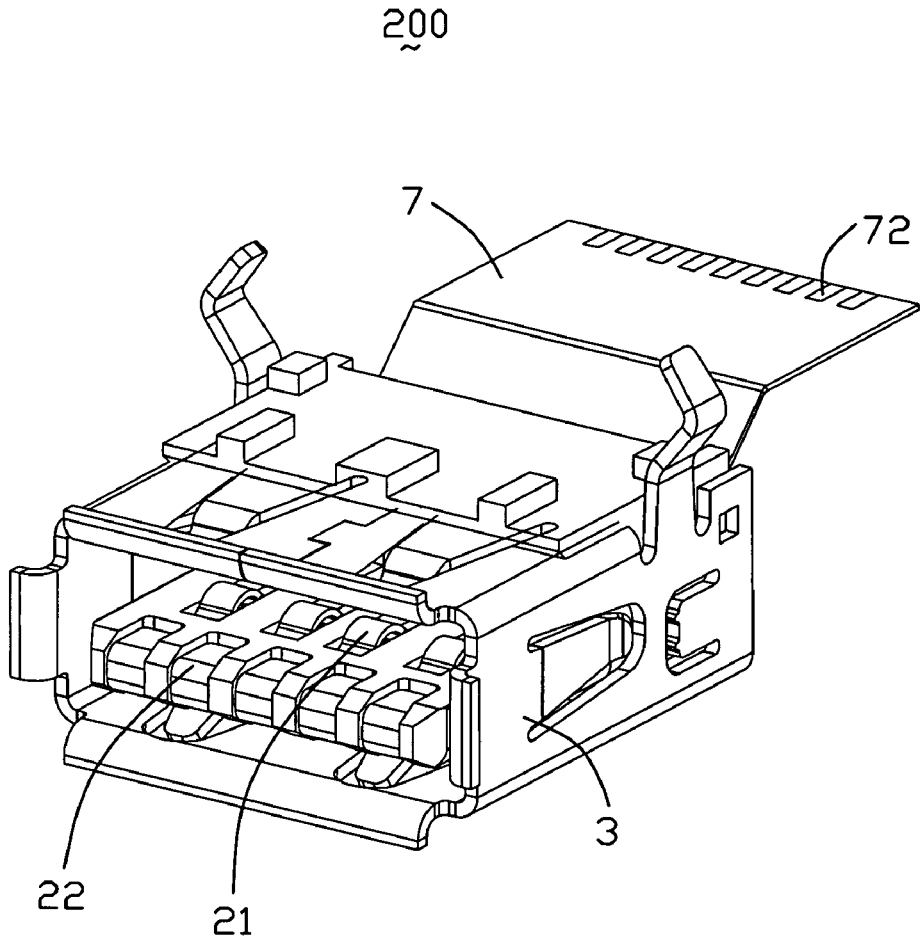
FIG. 7 is another perspective view of the electrical connector shown in FIG. 6, but viewed from another aspect.
Figure 8:
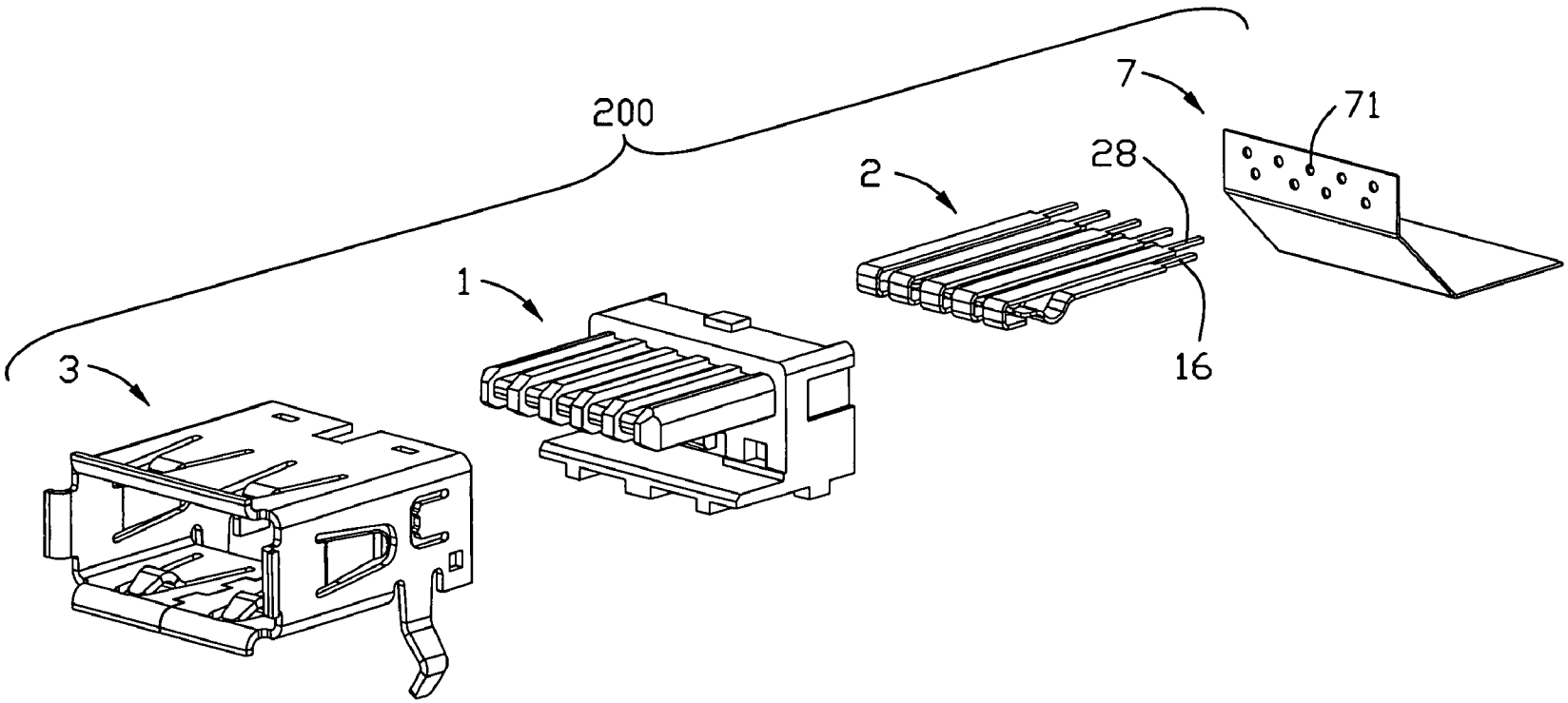
FIG. 8 is a partly exploded view of the electrical connector according to the second embodiment of the present invention.
Figure 9:
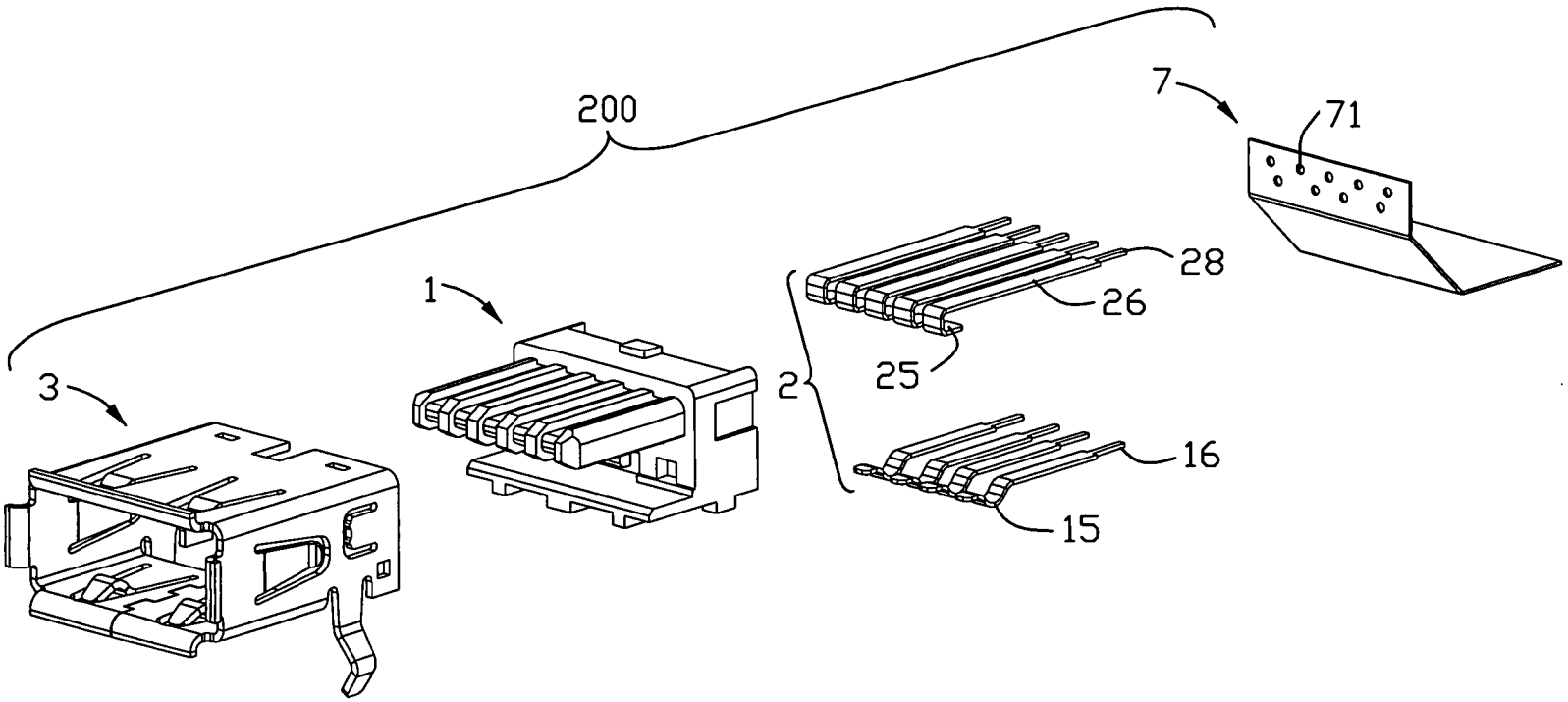
FIG. 9 is an exploded view of the electrical connector according to the second embodiment of the present invention.
Figure 10:
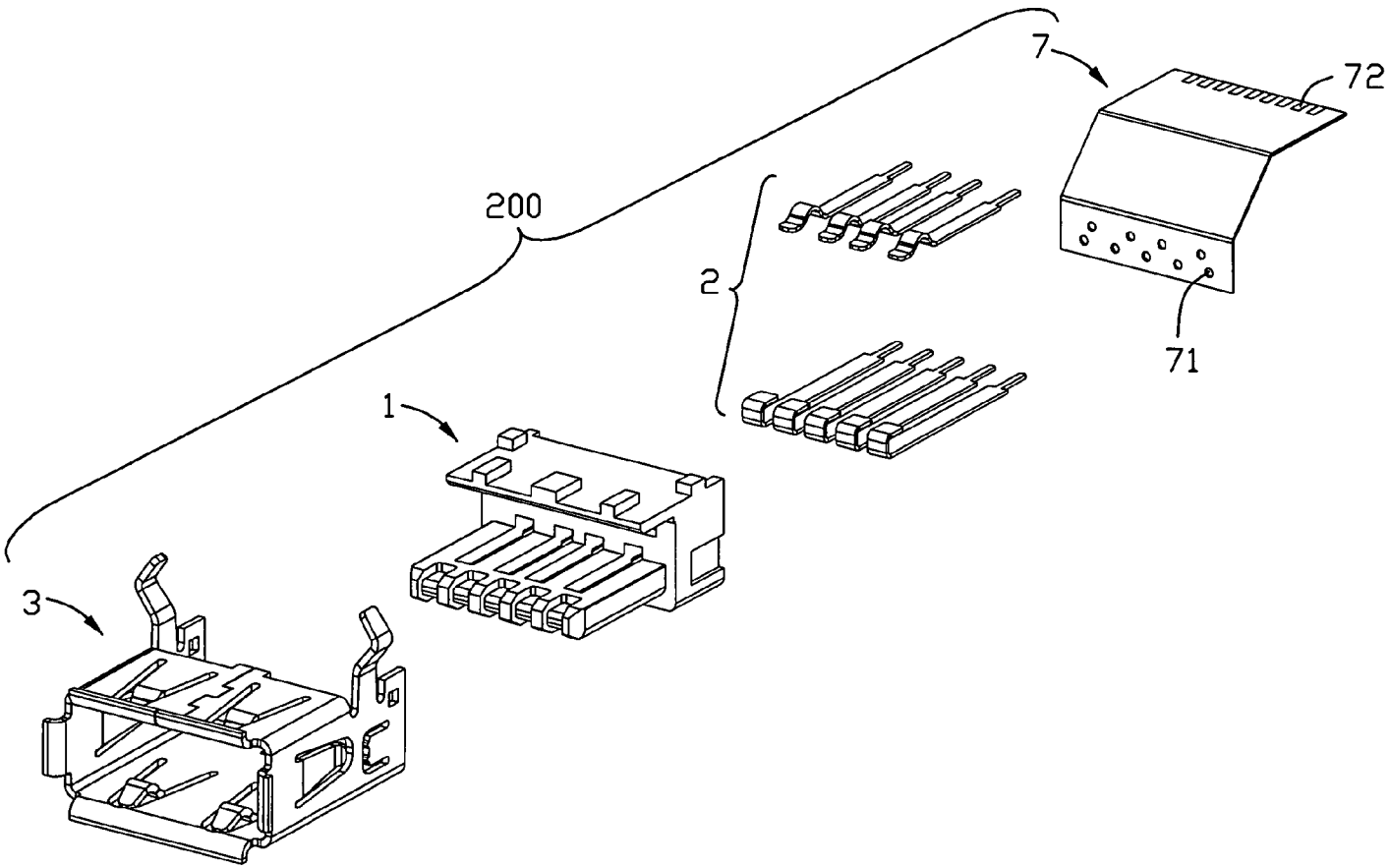
FIG. 10 is another exploded view of the electrical connector shown in FIG. 9, but viewed from another aspect.
Figure 11:
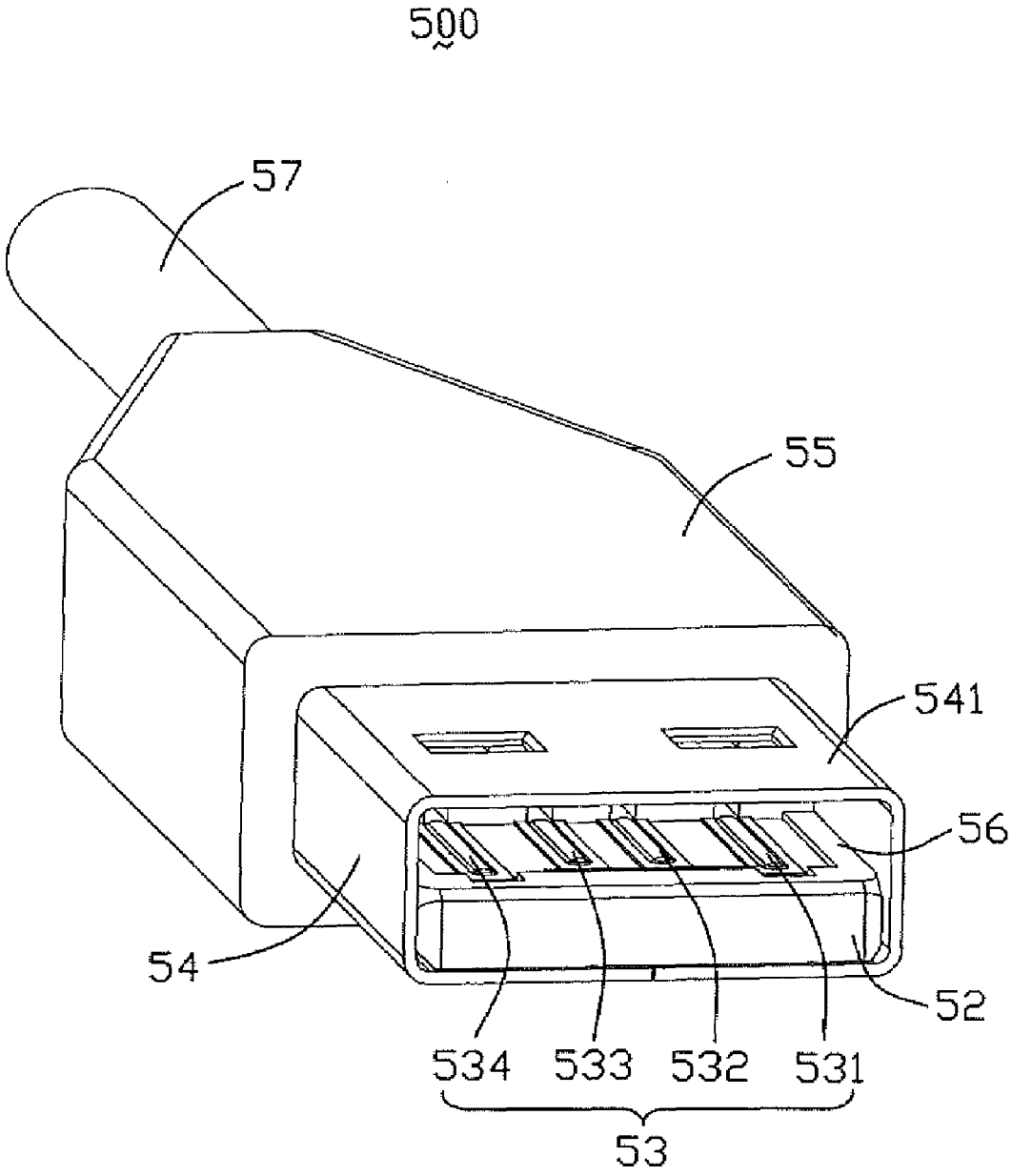
FIG. 11 (PRIOR ART)
FIG. 11 is a perspective schematic view of the standard type-A USB 2.0 plug connecting with a cable.

As shown in FIGS. 3-5, the contacts 2 include a plurality of conductive contacts 21 received in the second passageways 142, and a plurality of additional contacts 22 received in the first passageways 131 and the depressions 141. Each conductive contact 21 includes an elastic first contact portion 15 and a first tail portion 16 extending from the first contact portion 15. All the first contact portions 15 of the conductive contacts 21 are disposed side by side along the transverse direction B-B. The conductive contacts 21 are cantileveredly accommodated in the corresponding second passageways 142 with the first contact portions 15 protruding downwardly beyond the mounting wall 14 so that the first contact portions 15 are deformable along a height direction C-C of the electrical connector 100 with insertion of the corresponding plug (not shown). The front-to-back direction A-A, the transverse direction B-B and the height direction C-C are perpendicular to each other.

As shown in FIGS. 3-5, the additional contacts 22 include two pairs of differential contacts 23 and a grounding contact 24. The two pairs of differential contacts 23 are used for transferring/receiving high-speed signals, and the grounding contact 24 is disposed between the two pairs of differential contacts 23 for reducing cross-talk. The additional contacts 22 are disposed side by side along the transverse direction B-B. Each additional contact 22 comprises a stiff and non-elastic second contact portion 25, a second tail portion 28 and a connecting portion 26 connecting the second contact portion 25 and the second tail portion 28. The connecting portion 26 is parallel to the second contact portion 25 while they are located on different levels. In detail, the connecting portion 26 is located higher than the second contact portion 25.

In assembly, the contacts 2 are inserted into the insulative housing 1. The connecting portions 26 are received in the first passageways 131. The second contact portions 25 are received in the depressions 141. The first contact portions 15 are received in the second passageways 142. All the first and the second contact portions 15, 25 are positioned at a same side of the tongue portion 12. The first and the second contact portions 15, 25 are arranged in two parallel rows along the front-to-rear direction A-A in condition that the second contact portions 25 are nearer to the mating end 18 than that of the first contact portions 15 as best shown in FIG. 4. The first and the second contact portions 15, 25 are separate along the front-to-rear direction A-A to prevent disordered signal transmission.

Figure 12:
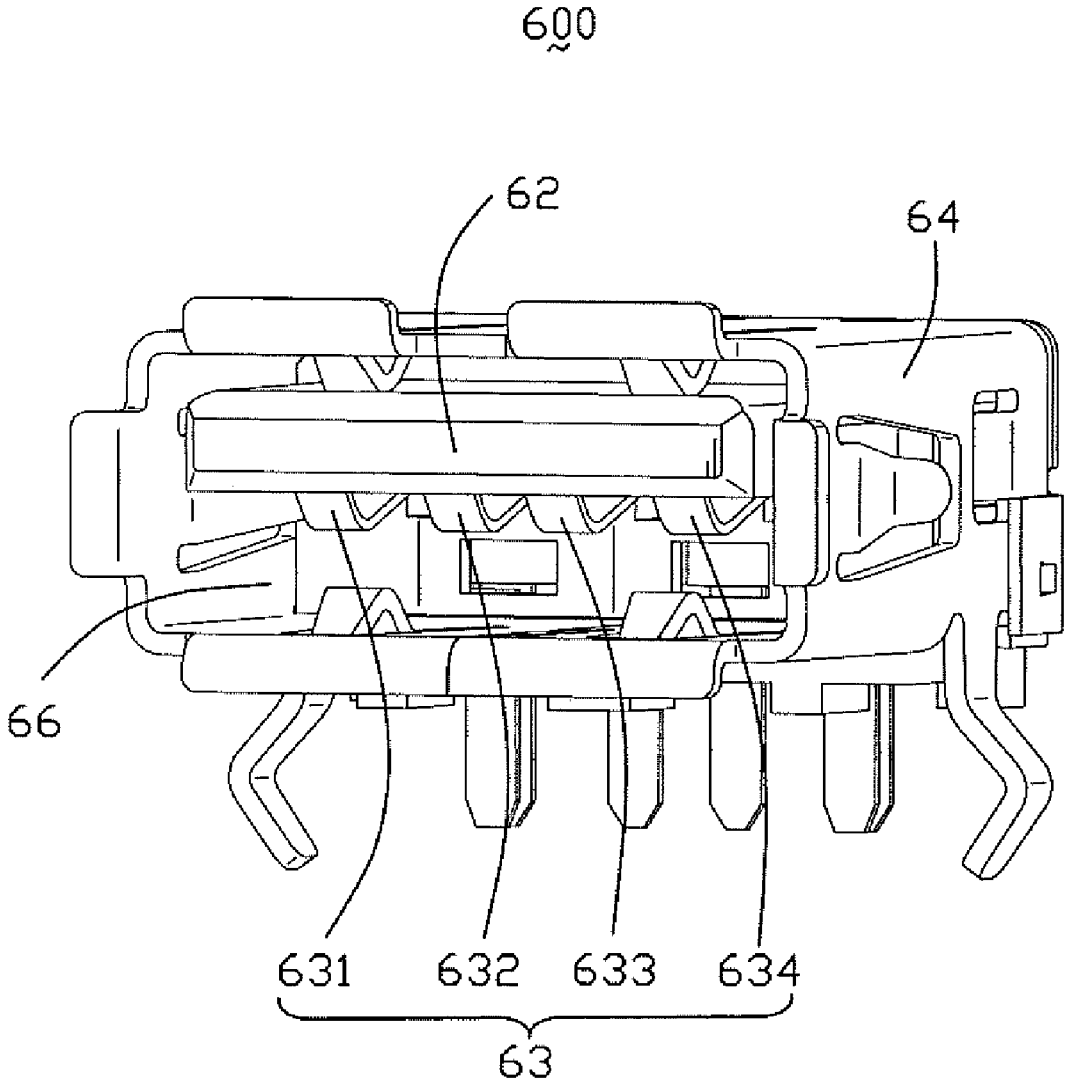
FIG. 12 (PRIOR ART)
FIG. 12 is a perspective view of an existing standard type-A USB 2.0 receptacle.

The electrical connector 100 is compatible to the standard type-A USB 2.0 plug 500 shown in FIG. 12. In order not to enlarge the profile of the electrical connector 100, a geometric profile of the tongue portion 12 is substantially the same as the tongue portion 62 of the standard type-A USB 2.0 receptacle 600 within an allowable tolerance, that is to say, length, width and height of the tongue portion 12 are substantially equal to the tongue portion 62. The number of the conductive contacts 21 is four and the arrangement of the conductive contacts 21 is compatible to USB 2.0 protocol to transmit USB signals. The four conductive contacts 21 are designated with numeral 211, 212, 213 and 214 for easy description hereinafter. The four conductive contacts 211, 212, 213 and 214 are adapted for power (VBUS) signal, – data signal, + data signal and grounding, respectively. So now, from assignment of the conductive contacts standpoint, different terminologies are given to each of the four conductive contacts 211, 212, 213 and 214. The four conductive contacts 211, 212, 213 and 214 are respectively named as power contact 211, – data contact 212, + data contact 213 and ground contact 214.

Regarding FIGS. 3-5, the metal shell 3 is in a tube shape, which defines a top face 31, a bottom face 32 opposite to the top face 31 and a pair of sidewalls 33 connecting the top face 31 and the bottom face 32. The metal shell 3 is secured to the base portion 11 to enclose the tongue portion 12 to form a receiving cavity 10 into which the tongue portion 12 extends. The top face 31 defines a slit 311 for receiving the protrusion 1111 of the insulative housing 1. Each sidewall 33 includes a projection 331 for abutting against the cutout 1131 of the insulative housing 1. Thus, the metal shell 3 can be secured to the base portion 11 firmly. The top face 31, the bottom face 32 and the sidewalls 33 all include at least one spring 310, 330 protruding into the receiving cavity 10 for retaining the corresponding inserted plug. The first contact portions 15 protrude into the receiving cavity 10 and the second contact portions 25 are exposed to the receiving cavity 10.

The transition module includes an inner PCB 4 and a plurality of transition contacts 9. The inner PCB 4 defines a plurality of first through holes 41, second through holes 42 and circuit traces 43 connecting the corresponding first and the second through holes 41, 42. The first through holes 41 are disposed in at least two rows and the second through holes 42 are only disposed in a single row under the first through holes 41. In assembly, the first and the second tail portions 16, 28 extend through the first through holes 41 and then to be soldered to the inner PCB 4.

The transition contacts 9 are L-shaped and include first portions 91 and second portions 92 perpendicular to the first portions 91. The first portions 91 are received in the second through holes 42 in order to electrically connect with the contacts 2. The second portions 92 are arranged in a single row and are used to be soldered to the mother PCB 8. In order to assure the second portions 92 parallel to each other for being easily soldered to mother PCB 8, the transition module further includes a positioning block 6 defining a plurality of holes 61 for the first portions 91 extending therethrough. The positioning block 6 is attached to the inner PCB 4 and is located between the inner PCB 4 and the second portions 92.

Referring to FIGS. 6 to 10, a second embodiment of the present invention discloses an electrical connector 200. The electrical connector 200 is much similar to the electrical connector 100 of the first embodiment. The difference between them are that the transition module of the electrical connector 200 is a flexible PCB 7 which includes a plurality of through apertures 71 for the first and the second tail portions 16, 28 extending therethrough, and a plurality of soldering pads 72 for being soldered to the mother PCB. The through apertures 71 electrically connect with the soldering pads 72.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector for being mounted on a mother PCB, comprising:

an insulative housing including a base portion and a tongue portion protruding beyond the base portion, the tongue portion extending along a front-to-rear direction and including a mating end opposite to the base portion;

a plurality of contacts held in the tongue portion, the contacts comprising a plurality of conductive contacts and at least one pair of differential contacts for transferring high-speed signals, each conductive contact comprising an elastic first contact portion and a first tail portion opposite to the first contact portion, and each differential contact comprising a stiff second contact portion and a second tail portion, all the first and the second contact portions being located at a same side of the tongue portion, and all the first and the second contact portions being arranged in two parallel rows along the front-to-rear direction in condition that the second contact portions being positioned nearer to the mating end than that of the first contact portions; and a transition module mechanically and electrically connected with the first and the second tail portions, and the transition module for being electrically connected to the mother PCB; wherein the each differential contact comprises a connecting portion connecting the second contact portion and the second tail portion, the second contact portion and the connecting portion being parallel to each other while being located on different horizontal levels.

2. The electrical connector as claimed in claim 1, wherein a geometric profile of the tongue portion is substantially the same as that of a standard type-A USB 2.0 receptacle.

3. The electrical connector as claimed in claim 1, wherein the transition module includes an inner PCB and a plurality of transition contacts electrically connected to the inner PCB, the inner PCB defining a plurality of first through holes to receive the first and the second tail portions, a plurality of second through holes and a plurality of circuit traces connecting the corresponding first and the second through holes, the transition contacts comprising first portions electrically connected to the second through holes, and second portions for being soldered to the mother PCB.

4. The electrical connector as claimed in claim 3, wherein the first portions extend through the second through holes and are soldered to the inner PCB, the second portions extending from the first portions and being perpendicular to the first portions.

5. The electrical connector as claimed in claim 3, wherein the first through holes are arranged in at least two rows and the second through holes are arranged in only one row, the second portions of the transition contacts being arranged in only one row as well.

6. The electrical connector as claimed in claim 3, wherein the transition module includes a positioning block located between the inner PCB and the second portions of the transition contacts, the positioning block defining a plurality of holes for the first portions extending therethrough.

7. The electrical connector as claimed in claim 1, wherein the transition module is a flexible PCB which defines a plurality of through apertures for the first and the second tail portions extending therethrough, and a plurality of soldering pads electrically connecting with the through apertures.

8. The electrical connector as claimed in claim 1, wherein the conductive contacts consist of a power contact, a ground contact, a – data contact and a + data contact, wherein an arrangement of the conductive contacts is compatible to USB 2.0 protocol.

9. The electrical connector as claimed in claim 1, wherein another pair of differential contacts are positioned at a lateral side of said pair of differential contacts, and a grounding contact being located between said pair of differential contacts and the another pair of differential contacts.

10. The electrical connector as claimed in claim 1, further comprising a metal shell enclosing the tongue portion to form a receiving cavity, the first contact portion protruding into the receiving cavity and the second contact portion being exposed to the receiving cavity.

11. An electrical connector for being mounted on a mother PCB, comprising:

an insulative housing including a tongue portion extending along a front-to-rear direction, the tongue portion comprising a mating end and a mounting wall, the mounting wall defining a plurality of passageways and a plurality of depressions nearer to the mating end than that of the passageways;

a plurality of contacts comprising a plurality of conductive contacts and at least one pair of differential contacts, the conductive contacts comprising elastic first contact portions received in the passageways while extending beyond the mounting wall, and first tail portions opposite to the first contact portions, said differential contacts comprising nonelastic second contact portions attached to the depressions and second tail portions opposite to the second contact portions; and a transition module acting as a bridge to electrically connect the first and the second tail portions to the mother PCB; wherein each differential contact comprises a connecting portion connecting the second contact portion and the second tail portion, the second contact portion and the connecting portion being parallel to each other while being located on different horizontal levels.

12. The electrical connector as claimed in claim 11, wherein a geometric profile of the tongue portion is substantially the same as that of a standard type-A USB 2.0 receptacle.

13. The electrical connector as claimed in claim 11, wherein the transition module includes an inner PCB and a plurality of transition contacts electrically connected to the inner PCB, the inner PCB defining a plurality of first through holes to receive the first and the second tail portions, a plurality of second through holes and a plurality of traces connecting the corresponding first and the second through holes, the transition contacts comprising first portions electrically connected to the second through holes, and second portions arranged in a row for being soldered to the mother PCB.

14. The electrical connector as claimed in claim 11, wherein the conductive contacts comprise a power contact, a ground contact, a – data contact and a + data contact, wherein an arrangement of the conductive contacts is compatible to USB 2.0 protocol.

* * * * *